United States Patent [19]

Macksoud

[11] Patent Number: 4,881,437

[45] Date of Patent: Nov. 21, 1989

[54] ANGLE GUIDE DEVICE

[76] Inventor: Albert A. Macksoud, 558 Bevel Line Rd., R.R. #1, Leamington, Province of Ontario, Canada, N8H 3V4

[21] Appl. No.: 206,951

[22] Filed: Jun. 8, 1988

Related U.S. Application Data

[63] Continuation of Ser. No. 1,819, Jan. 8, 1987, abandoned.

[30] Foreign Application Priority Data

Apr. 11, 1986 [CA] Canada ..... 506524

[51] Int. Cl.[4] ..... B27B 27/08

[52] U.S. Cl. ..... 83/477.2; 83/468; 83/471.2; 83/522.11; 83/581

[58] Field of Search ..... 83/467 R, 468, 471.2, 83/473, 477, 477.1, 477.2, 490, 522, 581

[56] References Cited

U.S. PATENT DOCUMENTS

| | | | |
|---|---|---|---|
| 1,801,721 | 4/1931 | Caldwell | 83/477.2 |
| 3,645,306 | 2/1972 | Adams, Sr. | 83/477.2 |
| 3,841,188 | 10/1974 | Wiater | 83/477.2 |
| 3,901,498 | 8/1975 | Novak | 83/477.2 |
| 4,158,320 | 6/1979 | Kay | 83/477.2 |
| 4,336,733 | 6/1982 | Macksoud | 83/477.2 |
| 4,441,394 | 4/1984 | Barsotti | 83/581 |
| 4,464,962 | 8/1984 | Myhre | 83/425 |

*Primary Examiner*—Frank T. Yost
*Assistant Examiner*—Eugenia A. Jones
*Attorney, Agent, or Firm*—Dykema Gossett

[57] ABSTRACT

Device for guiding a workpiece to be cut at any of a plurality of angles on a power saw and like cutting machine of the type including a tabletop and a blade movable within a cutting line for cutting the workpiece held stable on the tabletop. The device includes a pair of guiding bar; one bar is constantly set at an angle of 90° degrees with respect to the cutting line, and the other bar can be set at any of a plurality of angles between 0° degrees and 0° degrees with respect to the cutting line. The device is removably mounted on the machine.

5 Claims, 2 Drawing Sheets

ANGLE GUIDE DEVICE

This is a continuation of co-pending application Ser. No. 001,819 filed on Jan. 8, 1987, now abandoned.

TECHNICAL FIELD

A device for guiding a workpiece to be cut at any of a plurality of angles on a power saw or on like cutting machines including a tabletop for supporting the device and the workpiece to be cut, and a blade movable within a cutting line for cutting the workpiece held stable on the tabletop of the machine.

BACKGROUND ART

Rocking arm circular saws are known in the art, as evidenced by U.S. Pat. No. 4,336,733 issued June 29, 1982, to Macksoud. The saw shown in this prior patent is of a bench or tabletop type construction which allows both cross-cutting and ripping operations to be performed. The circular saw blade and associated driving motor therefor are both mounted on a rocking arm which is pivotally supported on the base of the saw, beneath a tabletop-like, horizontal surface which supports the workpiece to be cut. A generally U-shaped handle connected to the rocking arm assembly extends above the tabletop and provides the saw operator with a handle for rocking the saw blade from a lowered, retracted position beneath the tabletop to a raised cutting position in which at least a portion of the blade extends through a slot in the tabletop, above the tabletop surface. Cross-cutting operations are performed by maintaining the workpiece stationary on the tabletop and rocking the saw blade from its lowered retracted position to its raised cutting position, thereby pulling the blade through the workpiece to effect the cut.

Although the rocking arm saw described above is highly effective in operation and simple to use it has guiding means lacking versatility in guiding a workpiece to be cut at an angle different than 90° degrees, the guiding means used on this machine is simply a single bar set on the tabletop for guiding at 90° degres while the cross-cutting operations of this machine require guiding for cutting at many different angles.

On the other hand some tablesaws and like cutting machines including a cutting blade movable along a cutting line for cutting a workpiece held stable on the tabletop have guiding arrangements relatively costly when cutting little workpieces at different angles during continuous work, the same as turning and returning a heavy tabletop of a machine or turning and returning a heavy arm carrying a saw assembly and its driving motor for doing a little cut that may take no more than a second of cutting duration.

Therefore the guiding device of the present invention includes two guiding bars, one bar is constantly stable on the tabletop for guiding a workpiece to be cut at 90° degrees and the other bar is pivotally adjustable on the tabletop with respect to the cutting line of the blade for guiding a workpiece to be cut at any of a plurality of angles.

The operator of the machine may have both guiding bars of the device adjacent each other on the tabletop as one bar set for guiding at an angle of 90° degrees for better use of the tabletop when there is no cutting at other angles required, or he may use one bar for guiding at an angle of 90° degrees and the other bar for guiding at another selected angle at the same time because no one bar of the device disturbs the other bar setting or guiding.

However, it is a primary object of the invention to provide a guiding device for a rocking arm saw capable of solving the guiding problems in its cross-cutting operations while at the same time, consideration must be given to the ease and portability of the saw. The saw described in U.S. Pat. No. 4,336,733 mentioned above is lightweight, compact and may be quickly converted into a readily portable package, consequently it is necessary that the angle guiding device be compatible with the portability of the saw and the ease with which it may be set up and taken down.

Another object of the invention is to improve the guiding of power saws and cutting machines of the type described here above and to make their guiding much less costly.

Other objects of the invention will be made clear or become apparent during the course of the following descriptions.

SUMMARY OF THE INVENTION

According to the present invention, a device provided for guiding a workpiece to be cut at any of a plurality of angles on a power saw or like cutting machine of the type including a tabletop and a blade movable along a cutting line for cutting the workpiece held stable on the tabletop across the cutting line.

Specifically the device includes first guiding bar which is a rectangular bar releasably mounted across a portion of the tabletop between the cutting line of the blade and a lateral side end of the tabletop by means of a pair of pins extending downwardly from the bottom side of the bar and inserted in a pair of holes adapted in the tabletop for the purpose and the first guiding bar is set at an angle of 90° degrees with respect to the cutting line, a second guiding bar equal to the first guiding bar in length width and height disposed freely on the tabletop beside the first guiding bar between the first guiding bar and a foreside end of the tabletop having an end adjacent the cutting line connected with a pivoting connector fixed at an end of the first guiding bar adjacent the cutting line so that the second guiding bar may pivot about the connected end between the first guiding bar and the cutting line.

The device includes a track inside the second guiding bar with a narrow top opening along the track, a block slidable along the track including a shaft extending upwardly through the top opening, and an arm having one end pivotally mounted on the first guiding bar and the other end mounted on the second guiding bar through which the shaft of the block passes so that the pivotal movement of the second guiding bar between the first guiding bar and the cutting line induces a sliding movement of the block inside the track, and a locking means mounted on the shaft above the arm end for selectively locking the arm end against sliding movement so that any position of the second guiding bar between the first guiding bar and the cutting line becomes an angle suitable for guiding.

The device also includes numerals along the second guiding bar and a pointer at the end of the arm for selecting an angle for guiding, a chamber at an end of the track as a track cleanout and a gap between the two bars for insuring a proper closing of the device when saw dust is present on the tabletop.

DESCRIPTION OF THE PREFERRED EMBODIMENT

Figure 1:
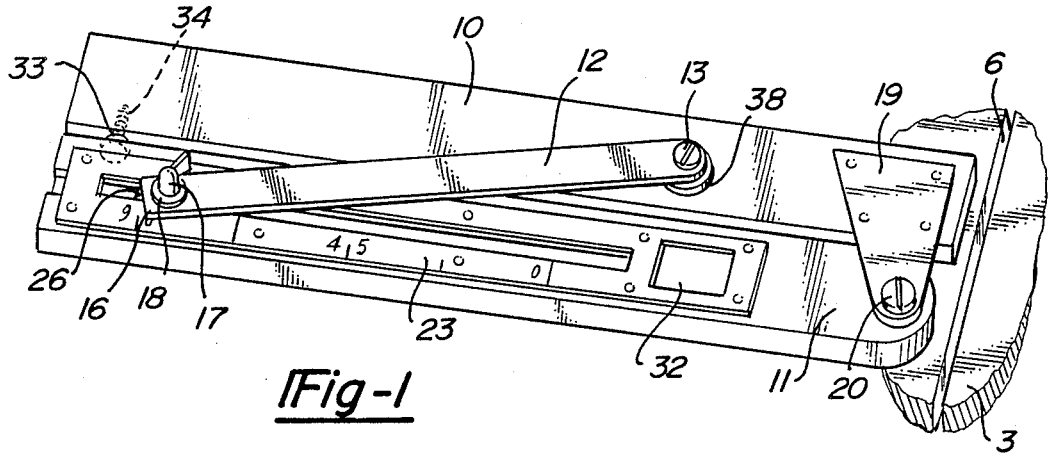
FIG. 1 is a perspective view of the guiding device of the present invention.
Figure 2:
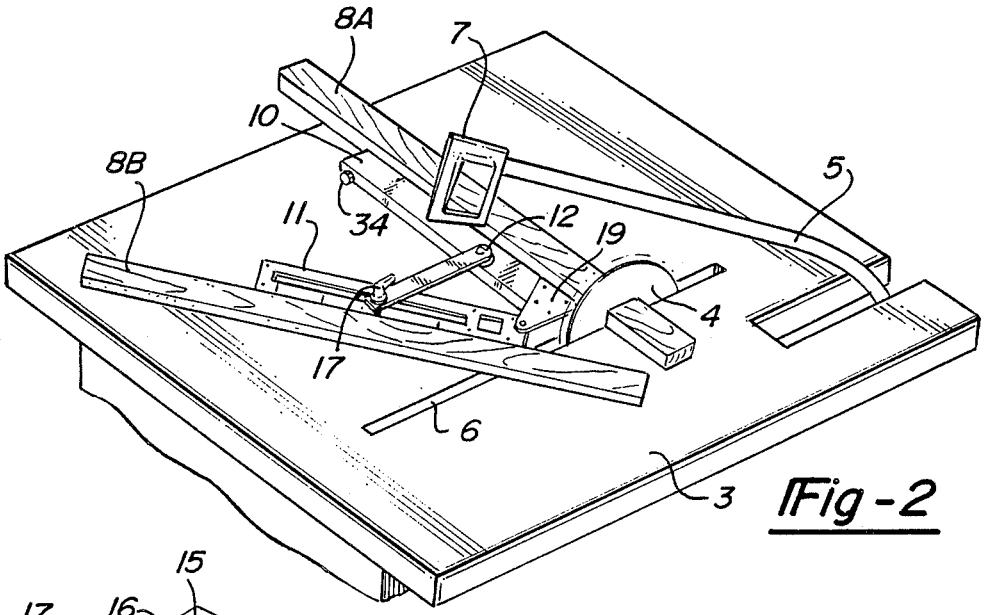
FIG. 2 is a perspective fragmentary view of the device employed by a Rocking Arm Saw.

Referring to FIGS. 1 and 2 of the Drawings, the present invention involves a device for guiding a workpiece to be cut at any of a plurality of angles on a power saw and like cutting machine including a tabletop 3 a blade 4 and a handle 5 for imparting movement to the blade 4 for cutting either of the workpieces 8A or 8B which are held stable against bar 10 and bar 11 of the device of the present invention across the cutting line 6.

Figure 3:
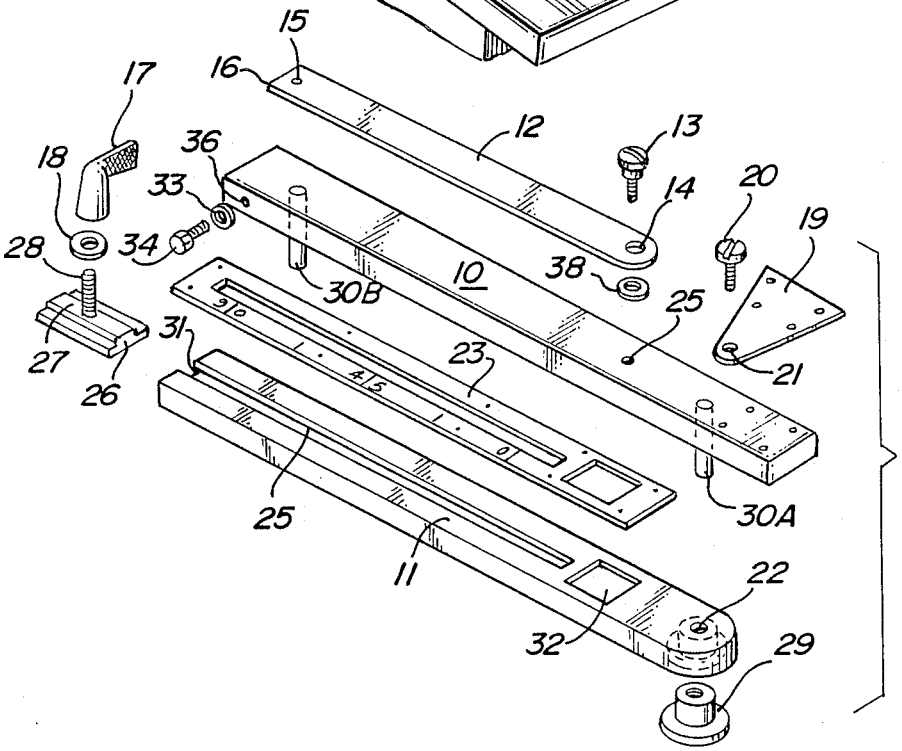
FIG. 3 is a perspective exploded view of the guiding device.

Best shown in FIGS. 1, 2, and 3 is the device comprising a pair of bars equal in length, width, and height, identified as "first guiding bar" 10 and "second guiding bar" 11 and both bars are mounted on the tabletop 3 of the machine beside each other as a unit between the cutting line 6 and a lateral side end of the tabletop 3 within the cutting range of blade 4, and at an angle of 90° degrees with respect to the cutting line 6. A pair of opposing pins 30A and 30B are extended downwardly from the bottom side of the first guiding bar 10 and inserted in a pair of holes (now shown) in the tabletop 3 whereby the device is releasably mounted.

One end of bar 11 is pivotally connected with bar 10 at an end of bar 10 adjacent the cutting line 6 and the other end of bar 11 is swingable between bar 10 and the cutting line 6. The pivotal connection of bar 11 with bar 10 is provided by a triangular plate of metal 19 of which a portion of two corners is fastened on bar 10 at an end of bar 10 adjacent the cutting line 6 and the other portion of plate 19 is extended beyond bar 10 for substantially covering the end of bar 11 which has an aperture 22 in the center and a lug 29 inserted in aperture 22 from the bottom side of bar 11 and tightened to plate 19 above bar 11 by screw 20.

Bar 11 includes an internal channel 31 integrated with a relatively narrow top opening 25 extending along channel 31 and a cleanout chamber 32 formed by a short continuation of channel 31 inside bar 11 including a gradually elevated bottom and a wide open top, a rectangular block 26 slidable in channel 31 between the opposing ends of bar 11 including a narrow and slightly elevated strip 27 projecting along the center slidably engaged between the opposite sides of the elongated narrow opening 25 and a shaft 28 extending upwardly from the center of block 26 through opening 25 above the top surface of bar 11 including a threaded upper portion, a plate of metal 23 substantially covering the top surface of bar 11 including an aperture discovering the top opening 25 of chamber 32 and a slot 24 discovering the elongated top opening 25 of channel 31 except a small portion at each of opposing ends as shown in FIG. 1 and numerals engraved along a side of slot 24.

The pivotal movement of bar 11 is controlled by an arm 12 including one end pivotally mounted on bar 10 over plate 28 by screw 13 and the other end mounted on bar 11 through which and through a pressure plate 18 set over the end of arm 12 the shaft 28 of block 26 passes for forming with the end of arm 12 a unit slidable along bar 11 by a reciprocal movement of bar 11 between bar 10 and the cutting line 6, a locknob 17 engaging the threads of shaft 28 for selectively applying locking pressure between block 26, bar 11, the end of arm 12 and plate 23, a pointer 16 at the end of arm 12 selectively slidable over the numerals engraved on plate 23.

The device includes also an even gap maintained between bar 10 and bar 11 when the two bars are in parallel position with respect to each other by the pivotal connection assembly at one end of the two bars and by a plate 33 fastened at the other end of bar 10 by screw 34 which has a long head inserted in a hole 27 in the opposite side of bar 11 when the two bars are in parallel position with respect to each other.

The embodiments of the invention in which an exclusive property or privilege is claimed are defined as follows:

1. A device for guiding a workpiece to be cut at a right angle and at a plurality of angles on a table saw, said table saw including a blade, a tabletop and a cutting line along which said blade passes for cutting said workpiece; said device comprising:

a first guide means fixed to said tabletop adjacent said cutting line at a permanent 90° angle with respect to said cutting line;

a second guide means interconnected to said first guide means, said second guide means being selectively adjustable with respect to said first guide means for adjusting the angle of said second guide means with respect to said cutting line;

a first connecting link pivotally interconnecting said first and second guide means allowing pivotal movement of said second guide means with respect to said first guide means;

a second connecting link interconnecting said first and second guide means for controlling said pivotal movement of said second guide means with respect to said first guide means, said second connecting link having opposed ends with one end pivotally attached to one of said first and second guide means and said other end slideably connected to said other of said first and second guide means for longitudinal movement there along;

said first and second guide means each having inner sides facing one another and outer sides, said outer side of said first guide means being adapted to receive a workpiece in abutting engagement and position the workpiece across said cutting line at a right angle to said cutting line for cutting the workpiece at a right angle;

said outer side of said second guide means being adapted to receive a workpiece in abutting engagement and position the workpiece across said cutting line at a preselected angle to said cutting line for cutting the workpiece at said preselected angle;

whereby said device may be used for guiding a workpiece for perpendicular cuts and for preselected angled cuts by abutting a workpiece against said outer side of said first or second guide means.

2. The device of claim 1, further including locking means for locking said first and second guide means with respect to one another.

3. The device of claim 1, wherein said first guide means includes means for releaseably mounting said device on said tabletop whereby the device may be quickly and easily removed from said tabletop.

4. A device for guiding a workpiece to be cut at a right angle and at a plurality of angles on a table saw, said table saw including a blade, a tabletop and a cutting line along which said blade passes for cutting said workpiece; said device comprising:

a first guide means fixed to said tabletop adjacent said cutting line at a permanent 90° angle with respect to said cutting line;

a second guide means interconnected to said first guide means, said second guide means being selectively adjustable with respect to said first guide means for adjusting the angle of said second guide means with respect to said cutting line;

a first connecting link pivotally interconnecting said first and second guide means allowing pivotal movement of said second guide means with respect to said first guide means;

a second connecting link interconnecting said first and second guide means for controlling said pivotal movement of said second guide means with respect to said first guide means, said second connecting link having opposed ends with one end pivotally attached to one of said first and second guide means and said other end slideably connected to said other of said first and second guide means for longitudinal movement;

locking means for locking said first and second guide means with respect to one another;

said first and second guide means each having vertical inner sides facing one another and vertical outer sides, said workpiece abutting said vertical outer side of said first guide means to make 90° cuts or alternatively abutting said vertical outer side of said second guide means to make preselected angled cuts with respect to said cutting line;

whereby said device may be used for guiding said workpiece for perpendicular and angled cuts by abutting said workpiece against said outer side of said first guide means or abutting said workpiece against said outer side of said second guide means.

5. The device of claim 4, wherein said first guide means includes means for releaseably mounting said device on said tabletop whereby the device may be quickly and easily removed from said tabletop.

* * * * *